United States Patent [19]

Eisermann

[11] Patent Number: 4,953,683

[45] Date of Patent: Sep. 4, 1990

[54] SAFE EQUIPPED WITH A PERMUTATION LOCK WHOSE LOCKING FUNCTION IS RELEASED BY THE INSERTION OF A COIN OR COINS

[75] Inventor: Armin Eisermann, Velbert, Fed. Rep. of Germany

[73] Assignee: Schulte Schlagbaum Aktiengesellschaft, Velbert, Fed. Rep. of Germany

[21] Appl. No.: 17,771

[22] Filed: Feb. 24, 1987

[30] Foreign Application Priority Data

Feb. 24, 1986 [DE] Fed. Rep. of Germany ..... 3605859
Jul. 19, 1986 [DE] Fed. Rep. of Germany ... 8619493[U]

[51] Int. Cl.[5] ..... E05G 1/02

[52] U.S. Cl. ..... 194/235; 70/DIG. 41; 70/304; 70/315; 70/432; 109/64; 109/59 R; 194/253; 194/259; 194/350

[58] Field of Search ..... 194/232, 234, 235, 247, 194/249, 253, 259, 350; 70/DIG. 41, 304, 315, 432; 109/59 T, 59 R, 50, 52, 56, 58, 58.5, 64, 73, 75

[56] References Cited

U.S. PATENT DOCUMENTS

| | | | |
|---|---|---|---|
| 259,415 | 6/1882 | Morse et al. | 109/56 X |
| 3,611,761 | 10/1971 | Atkinson | 70/315 X |
| 4,249,469 | 2/1981 | Craske | 109/50 X |
| 4,391,204 | 7/1983 | Mitchell et al. | 109/64 X |
| 4,542,848 | 9/1985 | Peters | 109/64 X |
| 4,686,912 | 8/1987 | Fogleman et al. | 109/59 T |

FOREIGN PATENT DOCUMENTS

| | | | |
|---|---|---|---|
| 0139026 | 5/1985 | European Pat. Off. . | |
| 2839527 | 3/1980 | Fed. Rep. of Germany | 194/253 |
| 3328694 | 2/1985 | Fed. Rep. of Germany | 194/247 |

*Primary Examiner*—Joseph J. Rolla
*Attorney, Agent, or Firm*—Martin A. Farber

[57] ABSTRACT

A safe having a safe door which can be locked by means of a permutation lock. To permit the safe to be used by a series of different persons, the permutation lock (5) is equipped with an externally operatable device for resetting the combination, and also is used in conjunction with a coin-operated release mechanism (19).

28 Claims, 16 Drawing Sheets

19
20
132
133
134
135
145
129
127
128
114
122
172
152
173
123
117
151
124
160
159
163
161
158
162
137
136
167
121
125
126
154
155
156
157
164
165
170
146
130
131
139
141
140
138
150
169
149
168
153
116
120
118
119
175
171
115

SAFE EQUIPPED WITH A PERMUTATION LOCK WHOSE LOCKING FUNCTION IS RELEASED BY THE INSERTION OF A COIN OR COINS

FIELD AND BACKGROUND OF THE INVENTION

The invention relates to the design of a safe having a door which can be locked by means of a permutation lock.

Safes are known whose door bolts are operated by means of a key-activated lock. Such safes are disadvantageous when they are used by a number of different people (e.g., in hotels, swimming pools, sport facilities) because in each case it is necessary to pass on the key to the next user. Handing over the key always involves the risk that the previous user may have made himself a copy of the key.

On the other hand, it is advantageous when a safe which is to be used by a number of different people is equipped with a permutation lock because, compared with key-activated locks, it is not necessary to hand over the key to the next user. It is however disadvantageous that anybody can use the safe free of charge because the person is not required to pick up a key for which the person must pay a rental fee.

It is a known feature of permutation locks that their key code can be adjusted from inside (e.g., the combination on a permutation lock fitted to a briefcase can be reset from inside the briefcase). This is disadvantageous in the case of safes which are constantly being used by different people because once the safe has been closed the newly set key code is no longer accessible for the user to note it down, for example, before the combination is manually scrambled. It would make very little sense to use such locks for example on hotel safes because guests would be frequently reporting to the reception desk asking for assistance in opening the safes because they had forgotten the key code which they had set.

SUMMARY OF THE INVENTION

It is therefore the object of the invention to create a safe of the type mentioned at the beginning which is suitable for use by a constantly changing series of users, yet which at the same time cannot be opened by unauthorized persons, and which also permits a rental fee to be collected.

In the safe according to the invention this problem is solved by using a permutation lock equipped with a device for resetting the combination from outside and also equipped with a coin-operated release mechanism. Combining the permutation lock with a coin-operated release mechanism means that the safe can only be used by the person who, at the start of the rental period, activated the permutation lock in such a way, by inserting a coin or coins that the lock can be operated to lock the door. Thus, by eliminating the weak point of key operated locks, namely the need to hand over a key, as is the case for example with lockers, the invention shows one way of providing a safe storage receptacle which can be used by a series of different people, while at the same time necessitating the payment of the user fee. In addition, the externally operatable combination resetting device used on the permutation lock also permits the selected combination to be read once the safe door has been closed; the combination itself is scrambled once it has been remembered or noted down. Thus it is a simple matter to read the combination even after the safe door has been closed. This eliminates what frequently happens in real life situations, namely that the user does not realize until after he has closed the door that he should have noted the combination, e.g., of a known type of combination resetting device accessible from inside (as in a briefcase). Such a device could not be used in a safe according to the invention because once the permutation lock is activated the coin inserted into the key-activated release mechanism falls into the collection container and opening the safe again to determine the combination would involve relocking it, which in turn would require payment of a further rental fee. The invention thus demonstrates a novel way in which—in contrast to the current state of the art—an externally operatable combination resetting device on a permutation lock is coupled with a coin-operated release mechanism.

In a further development of the invention the permutation lock is designed to store its combination once the bolt is activated to close the door. This is a fundamentally different feature from that found on known permutation locks which store their combinations by the user activating a separate button. In the object which is the subject of this patent application the combination is stored by the action of setting the permutation lock in the locked position. Thus, the combination set when closing the lock corresponds to the combination which has to be redialed in order to open the safe.

In a further development of the invention, the safe can be designed in such a way that the stored combination can be read off once a securely attached panel which is accessible from the outside has been removed. If the user of the safe forgets the combination, removal of this panel, which can only be done by authorized personnel, permits the combination to be read. In this way, the safe can be opened by calling on the assistance of an authorized person (e.g., hotel detective). This guarantees uninterrupted availability of the safes to the various users.

The panel is preferentially secured by at least one fastening element which is closable from outside. The fastening element must be released before the panel can be removed. This can only be done by means of a key-operated locking device. However, the keys which operate this locking device are not accessible to the users but only to an authorized person. In this way the security of the safe is not affected. Preferentially the fastening element takes the form of a threaded bolt which is prevented by a lock from being turned; this bolt is arranged on the panel and screws into a threaded borehole in the safe door.

In a further development of the invention, removal of the panel reveals a further covering panel secured by at least one seal. Because of its seal, this additional panel provides an immediate indication whether unauthorized people have attempted to tamper with the permutation lock in order to discover its combination.

The permutation lock can be designed in such a way that it possesses several coding knobs for setting the combination, as well as a bolt which can move between two end settings; the bolt slide bears locking pins which engage in rotatable locking disks controlled by the coding knob; a common change-over slide decouples the coding button and the locking disks; on the side-facing the bolt plate each of the locking disks possesses a radial slot which matches up with one of the locking pins mounted on the bolt slide; on the side facing away from the bolt slide, each locking disk has a diametrical groove carrying a locking slide, which runs in the change-over slide and engages in a toothed disk linked with the coding knob; each locking slide possesses a marking which is only visible through openings in the housing wall of the permutation lock when the locking slide and toothed disk are engaged at the setting of the stored combination. The locking slide and toothed disk engage only when the bolt is in its closed end position. The engagement is brought about by teeth, which are formed on the locking slide, engaging in the teeth on the toothed disk when the locking slide is displaced. If the parts are disengaged, the locking slide is retracted and its marking no longer lines up with the corresponding opening in the housing wall. The marking is then not visible. If, however, the parts are brought into engagement, the locking slide and thus its marking are displaced in such a way that they come to rest in the corresponding opening in the housing wall and can thus be read from outside. In this way it is possible, after removal of the panels, thereby exposing the housing of the permutation lock, to find out the combination by turning the coding knobs until all the markings are visible in the corresponding openings of the housing wall. The setting found in this way corresponds to the stored combination so that the permutation locks can be opened. Preferentially, each toothed disk should be combined with a spring loaded tumbler which at least partly covers the corresponding locking slide; these tumblers are released only in the bolt end positions and they possess recesses which permit the markings to be seen. The tumblers prevent the coding knobs from being operated when the bolt is in an intermediate position between its end positions. These tumblers thus enhance the security provided by the locks.

In a further development of the invention, the coin-operated release mechanism takes the form of an auxiliary lock whose locking function is released by inserting a coin; once the coin has been inserted, the locking slide of this auxiliary lock is free to move and it engages with the bolt slide of the permutation lock. Through this design, the bolt slide of the permutation lock can only be moved to the locked position after the auxiliary lock has been activated by inserting a coin. Only once the auxiliary lock has been activated in this way can its locking slide engage with and be driven by the bolt slide of the permutation lock. If no coin is inserted into the auxiliary lock, the locking slide is not released and this blocks the movement of the bolt slide of the permutation lock. The safe according to the invention cannot then be locked. Thus, the permutation lock cannot be used to lock the safe door until the locking slide of the auxiliary lock has been released.

The safe is preferentially formed in such a way that the coin-operated release mechanism possesses a coin chute opening into a coin collection chamber which is located behind a closable cover forming part of the outer surface of the safe door. This arrangement has the advantage that the coin chamber can be emptied by an authorized person without having to open the safe door. Thus the authorized person can open the cover and empty out the coins at any time without the user of the safe being present. The person emptying the coins does not have access to the contents of the safe because there is no connection between the coin collecting chamber and the interior of the safe. The coin collecting process is thus simple, advantageous and safe. In a further development of the invention the closing mechanism of the coin chamber lid can be designed in a manner similar to that described above for the removable panel.

It is advantageous if the permutation lock and the coin-operated release mechanism are arranged back to back. This is particularly the case when the safe door is of double wall construction with an inner and outer wall. In such a case the coin-operated release mechanism is mounted on the outer surface of the inner wall and the permutation lock is mounted on the inner surface of the inner wall and the coupling connection passes through an opening in the inner wall.

In addition, the safe can be designed in such a way that the panel and lid fit flush with the outer surface of the outer wall. This eliminates any projecting edges which would present a security risk because they would permit the application of burglary tools.

A simple design is achieved by using part of the space between the inner and outer walls of the safe door to form a coin collecting chamber. A further feature of the invention is that a coin slide passes through the inner wall and links the vertical coin chute with the coin collecting chamber. Furthermore, the door frame of the safe is fitted with a striking plate. When the lock is operated this striking plate is engaged by the head of a locking bolt formed by an extension of the bolt slide of the permutation lock; said slide being movable by means of an operating knob.

According to the invention, the permutation lock is combined with a coin-operated release mechanism to prevent a safe, situated for example in a hotel room, from being used free of charge. The permutation lock can be operated only if one or more coins are inserted, in payment of the rental fee, into the coin-operated release mechanism. A coin or coins must be inserted each time before the safe can be locked; therefore the user must have an adequate supply of appropriate coins with him. It is burdensome for a hotel guest, especially during a stay of several days, to keep a supply of such coins so that he can open or close his rented safe several times a day, as is usually the case, in order to place jewelery or cash in or remove it from the safe. The operating comfort of the safe is reduced by the need to keep a stock of coins and also by the need to insert a coin in the coin-operated release mechanism each time the safe is locked.

Therefore, in order to ensure user friendliness, according to the invention, the permutation lock operates in conjunction with a locking element which is unlocked by inserting a coin into the coin-release mechanism and the latter mechanism possesses an auxiliary lock which can unlock the lOcking element without inserting a coin. This measure permits the permutation lock to be operated without inserting a coin as long as the auxiliary lock is activated. This can be achieved, for example, by the hotel guest obtaining a key for the auxiliary lock from the reception desk, against payment of a fee for use of the safe. With the key the guest can activate the auxiliary lock and move the locking element to its unlocked position. The advantages of a permutation lock as described further above are fully retained. According to this version of the invention the hotel guest no longer needs to keep a stock of coins to use the safe because the activation of the auxiliary lock replaces the insertion of a coin or coins. The insertion of a coin or coins or the activation of the auxiliary lock are alternative measures so that if the auxiliary lock cannot be operated the locking element can be unlocked by inserting a coin or coins into the coin-operated release mechanism.

As already mentioned, in a further development of the invention; the auxiliary lock may possess a key-operated locking mechanism. In order to counteract misuse through copying of the keys for the auxiliary locks, it is also possible to select a permutation lock as the auxiliary lock. If a key-operated lock is chosen, it should preferably be of the cylinder type.

The safe can also be formed in such a way that the auxiliary lock possesses an effective mechanism which prevents the key from being withdrawn once it is moved to the position in which the locking element is released. The withdrawal-prevention mechanism prevents the key from being removed from the lock once the latter is operated and it thus also effectively prevents the loss of the key.

In a further development of the invention, the coin-operated release mechanism takes the form of a lock whose locking function can be released by inserting a coin/coins or by operating an auxiliary lock. In this case, the locking slide which forms the locking element is released by inserting a coin/coins or operating the auxiliary lock and it is then coupled with and moved by the bolt slide of the permutation lock. To close the safe it is necessary to slide the bolt slide of the permutation lock into the locked position When this is done the locking slide of the coin-operated release mechanism is also moved because this locking slide and the bolt slide of the permutation lock move together in coupled motion. However, the locking slide can only be moved if it is first released. If no coin is inserted into the coin-operated release mechanism or if the auxiliary lock is not operated, the locking slide remains locked and the bolt slide of the permutation lock can also not be moved because both slides are coupled with each other. This ensures that the permutation lock can only be activated and the safe can only be used if a coin is inserted or the auxiliary lock is operated.

The coupling connection is preferentially formed by an extension of the bolt slide coming into contact with a projection of the locking slide.

The arrangement can be formed in such a way that the coin-operated release mechanism possesses a pawl for the locking slide and this pawl is pivoted out of engagement by the edge of an inserted coin or by the web of the key when turned in the auxiliary lock. Once the locking pawl is disengaged, the locking slide is released so that the bolt slide of the permutation lock can also be moved to the closed position.

With the above and other objects and advantages in view, the present invention will become more clearly understood in connection with the detailed description of a preferred embodiment, when considered with the accompanying drawings, of which:

DETAILED DESCRIPTION OF THE PREFERRED EMBODIMENTS

Figure 1:
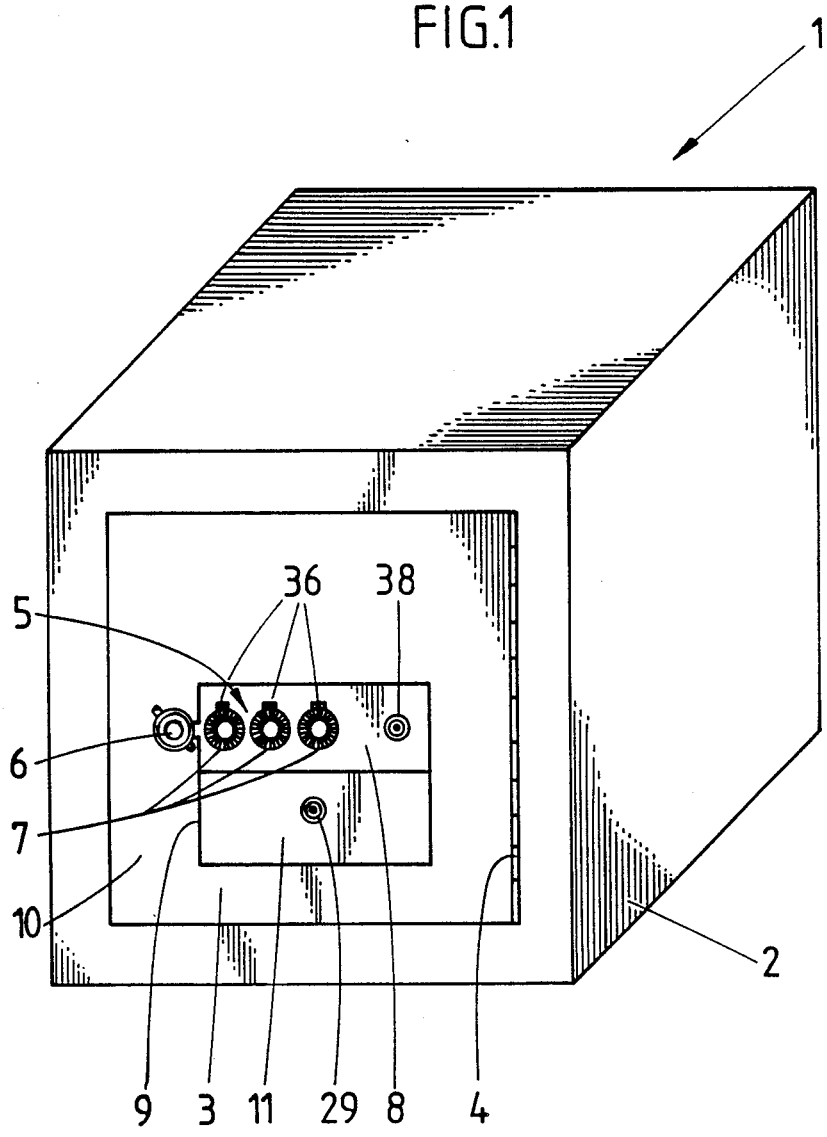
FIG. 1 is a perspective view of a safe.

As shown in FIG. 1, the safe 1 possesses an armoured housing 2 and a safe door 3 which securely seals off the space inside the safe. The safe door 3 which is attached to the safe by means of a right-hand mounted hinge 4, as shown in FIG. 1, is fitted with a permutation lock having an operating knob 6 and three coding knobs 7. The permutation lock 5 is covered by a panel 8 arranged in the upper area of a window 9 in the outer wall 10 of the safe door 3.

Below the panel 8 there is located a cover 11 filling the lower portion of the window 9. The panel 8 and the lid 11 are mounted flush with the outer wall 10 of the safe door 3.

Figure 2:
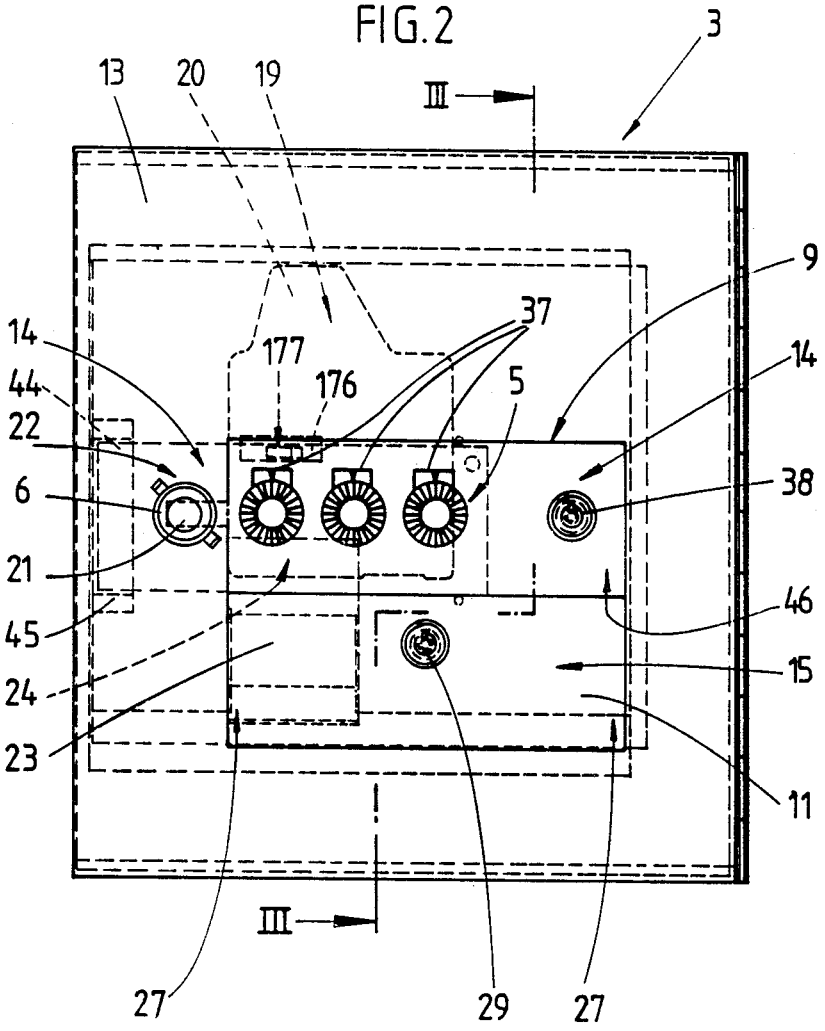
FIG. 2 is a top view of the safe door.
Figure 3:
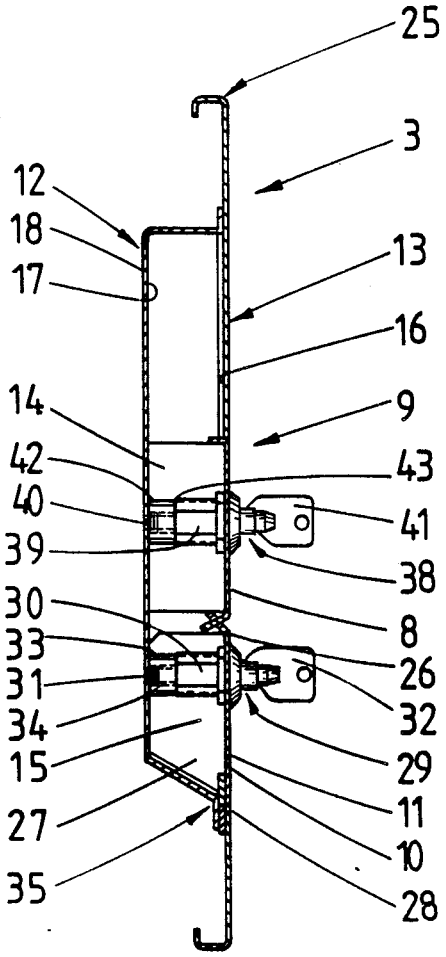
FIG. 3 is a cross-section of the safe door along line III—III in FIG. 2, but with the keys left in the locks.
Figure 12:
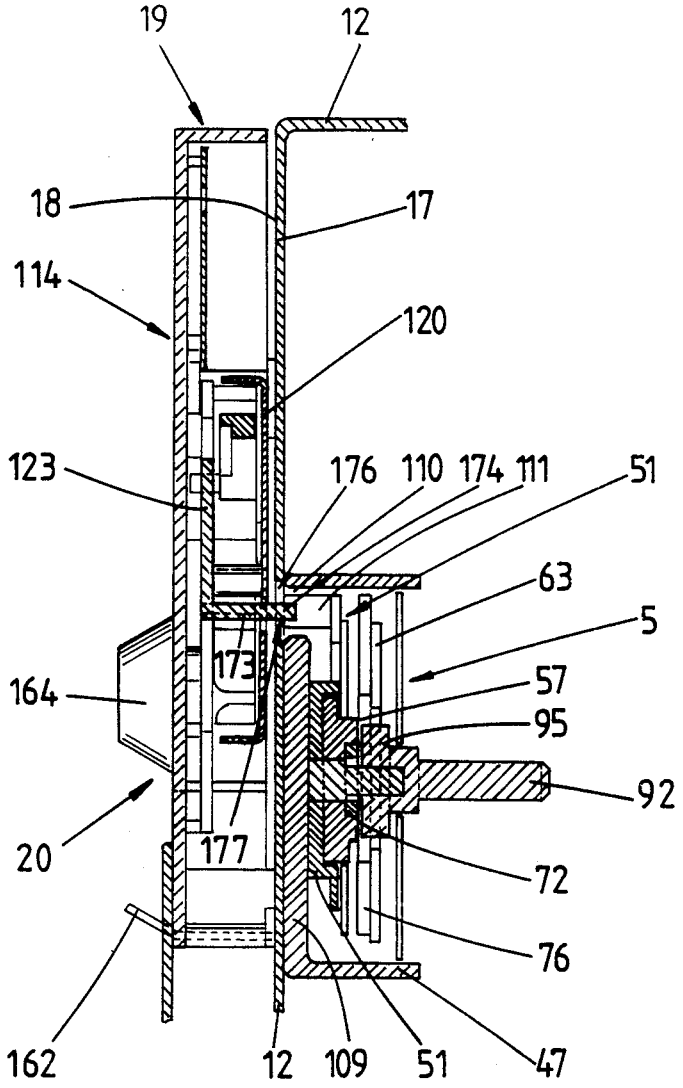
FIG. 12 is a cross-sectional view of an area of the safe door in which the back-to-back arrangement of the permutation lock and the auxiliary lock is apparent.

As shown in FIGS. 2 and 3, the safe door 3 is for the most part of double wall construction having an inner wall 12 and an outer wall 13, whereby a chamber 14 is formed to receive the permutation lock, and beneath that a coin collecting chamber 15 is created (see in particular FIG. 3). The permutation lock 5 is arranged in the permutation lock housing chamber 14 where it is attached to the inner side 16 of the outer wall 13 and the inner side 17 of the inner wall 12. A coin-operated release mechanism 19, forming an auxiliary lock 20, is attached to the outer side 18 of inner wall 12 (FIG. 2, FIG. 12).

The outer wall 10 of the safe door 3 bears a recess 21 open towards the window 9 through which passes a shaft 22 of permutation lock 5, which is connected with operating knob 6. According to FIG. 2 the inner wall 12 of safe door 3 has an opening through which passes a coin slide 23 which at one end discharges into the coin collecting chamber 15 and at the other end extends as far as the auxiliary lock 20 where it is connected with the vertical coin chute 24 of auxiliary lock 20.

According to FIG. 3 the outer edge 25 of door 3 is flanged to project inwards. Also according to FIG. 3, lid 11 possesses an upper and lower flanged edge 26 and angular supporting brackets 27 at both sides. In addition, a tab 28 is attached to the inner side of the lower edge of lid 11. Lid 11 is fitted with a fastening element 29 which is lockable from outside; this fastening element takes the form of a threaded bolt 31 which is prevented by a lock 30 from being turned. A key 32 can be inserted into lock 30 thus releasing threaded bolt 31 and allowing it to be turned. Thus, by turning key 32, the threaded bolt 31 can be turned with it. When lid 11 is fitted into position in window 9 (FIG. 3) the threaded bolt 31 lines up with a bushing 33 possessing an axial threaded borehole 34 which is fitted on the inner side 17 of inner wall 12. Threaded bolt 31 can be screwed into this threaded borehole 34. In this way the lid 11 is attached to the safe door 3 so that when the key 32 is withdrawn it is no longer possible to remove the lid. In order to achieve a firm fit between lid 11 and safe door 3, a slit 35 is formed between outer wall 13 and inner wall 12, and into this slit a tab 28 of lid 11 is inserted when lid 11 is fitted in place. In addition, lid 11 is supported at both sides against the inner side 17 of inner wall 12 by means of support brackets 27.

As shown in FIG. 1, the panel 8 possesses three openings 36 which line up with the coding knobs 7 of permutation lock 5; these openings are shaped like keyholes and in their upper section they expose markings 37 which indicate the settings of the coding knobs 7. According to FIG. 2 the lid 8 is fitted on the right side with a fastening element 38 which has the same structure as fastening element 29 and consequently possesses a lock 39, a threaded bolt 40 and a withdrawable key 41. A bushing 42 possessing a threaded borehole 43 is attached in alignment with threaded bolt 40 on the inner side 17 of inner wall 12. In the manner described above panel 8 can be attached to safe door 3 by means of fastening element 38; according to FIG. 2 a left hand bracket 44 of panel 8 then engages in a recess 45 formed on the inner side of outer wall 13 and, on the other side panel 8 possesses a supporting bracket 46 which, when panel 8 is fitted in place, braces the panel against the inner side 17 of inner wall 12. Thus, here too, only an authorized person having a key to operate fastening element 38 can remove panel 8.

Figure 4:
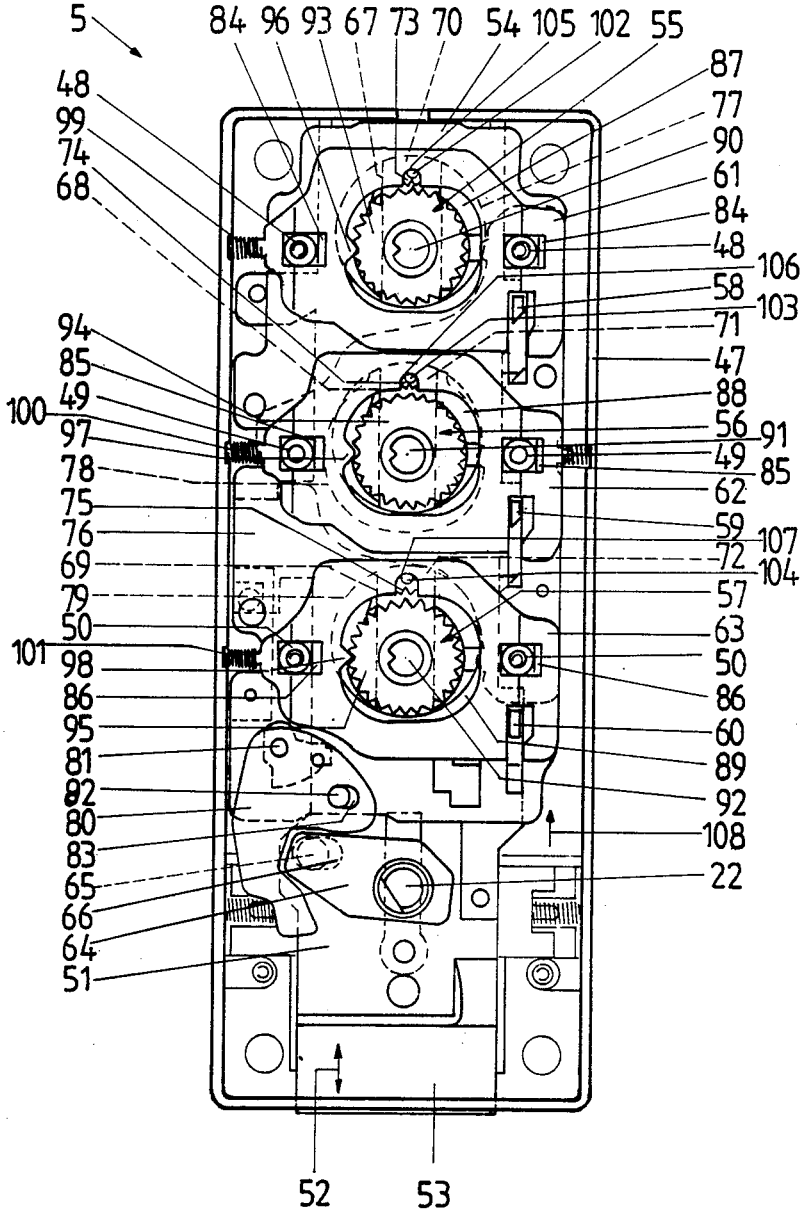
FIG. 4 is a top view of a permutation lock with the bolt in the opened position.

As shown in FIG. 4 the permutation lock 5 possesses a lock case 47 in which pairs of guide bolts 48, 49 and 50 are arranged. The permutation lock 5 is essentially the same type of lock as that known from European patent application No. 0 139 026. Reference is made to this latter application which is incorporated by reference herein in connection with disclosure of the present application. The pairs of guide bolts 48 to 50 are provided with threaded holes permitting a lock case lid 18 to be fastened in place in lock case 47. In addition, stud bolts, which are not visible in FIG. 4, are provided to act as guide pins for the shaft 22 of operating knob 6 and coding knobs 7. These stud bolts and also the pairs of guide bolts 48 to 50 form a guide for a bolt slide 51 which is slidingly mounted in lock case 47; the edges of the said bolt slide are in contact with the guide bolts 48 to 50 and it possesses longitudinal holes through which the stud bolts project. The bolt slide 51 is movable in the directions indicated by the double arrow 52. At its end the bolt slide possesses a head section 53 which engages in a striking plate (not shown) fitted in the door frame of the safe 1 in order to lock the safe door 3.

Three square-section locking pins are provided on the upper side 54 of locking bolt 51 and they engage in radial slots in rotatable locking disks 55, 56 and 57. Three further locking pins 58, 59 and 60 engage in associated tumblers 61, 62 and 63. Shaft 22, which is linked with the operating knob, possesses an arm 64 bearing a pin 65 at its end, and said pin engages in hole 66 in the angled bolt slide 51. By rotating the operating knob 6 the bolt slide 51 can be moved via arm 64 and the engagement between pin and hole. On its lower side each locking disk 55, 56 and 57 is provided with the radial slot described above in which the locking pins engage whenever the bolt slide 51 is in the open position. This engagement is brought about only if the locking disks are in the correct angular position to bring the radial slots into alignment with the locking pins. This position corresponds to the pre-selectable combination of the permutation lock. When just one locking disk is rotated out of the above mentioned position, the associated locking pin cannot engage in the appropriate lock, so that the bolt slide 51 cannot be released and moved to the unlocked position.

On their upper sides the locking disks 20 possess diametrically arranged grooves 67 to 69 which receive the locking slides 70 to 72. At one end the locking slides 70 to 72 carry locking teeth 73 to 75.

In addition, the permutation lock is fitted with a common change-over slide 76 possessing circular openings 77 to 79. The diameter of these openings 77 to 79 corresponds to that of locking disks 55 to 57. The change-over slide, which is also slidingly mounted so as to be longitudinally movable in the lock case 47, is however arranged in such a way over the locking disks 55 to 57 that it merely takes locking slides 70 to 72 with it when it is moved. The displacement of the change-over slide 76 is effected by means of a control link 80 which engages around arm 64 and can pivot around a pin 81 in the lock case 47. A control pin 82 is formed on the upper side of the change-over slide 76 and this pin engages in an elongated hole 83 in the control link 80. If the operating knob 6 is now turned and arm 64 is pivoted, control link 80 is also caused to pivot and then the change-over slide 76 is moved via the control pin 82 and the elongated hole 83.

The tumblers 61 to 63 possess pairs of elongated holes 84 to 86 by means of which they can be displaced transversely to the longitudinal orientation of the bolt slide 51 on the pairs of guide bolts 48 to 50. Each tumbler 61 to 63 possesses an oval opening 87 to 89. Shafts 90 to 92, which are hollow at one end and carry the coding knobs 7 at the other end, are mounted on the stud bolts (which are not shown). The shafts 90 to 92 are fixedly connected to toothed disks 93 to 95 with which they rotate; the heights of the various parts are matched in such a way that the teeth of the toothed disks 93 to 95 can engage not only in the locking teeth 73 to 75 but also in locking teeth 96 to 98 of tumblers 61 to 63. The tumblers 61 to 63 are held in engagement with the toothed disks 93 to 95 by means of coil springs 99 to 101.

Markings 102 to 104 are provided on the locking slides 70 to 72 alongside the locking teeth 73 to 75; when the locking slides 70 to 72 are out of engagement with the toothed disks 93 to 95 these markings are partially uncovered by recesses 105 to 107, the open ends of which connect up with the openings 87 to 89. The lid of the lock case 178 possesses openings through which pass the shafts 90 to 92 and shaft 22 and it also has other openings 180 located in the area where locking teeth 73 to 75 engage with the teeth of locking disks 93 to 95. When the locking slides 70 to 72 are in the retracted position shown in FIG. 4 the markings 102 to 104 are not visible through openings 180. When, however, the locking slides 70 to 72 are displaced so that the locking teeth 73 to 75 engage in the teeth of the locking disks 93 to 95, recesses 105 to 107 fully uncover the markings 102 to 104 which are then visible through the openings 180 in the lock case lid 178. The locking slides 70 to 72 are shown in this position in FIG. 5.

It should be mentioned that the change-over slide 76 is pretensioned in the direction of the arrow 108 by means of a spring which is not shown. In accordance with FIG. 12 the bottom wall 109 of lock case 47 possesses an opening 110 in which there is located an extension 111 of the bolt slide 51. The extension 111 is thus moved together with and in the longitudinal direction of the bolt slide 51 when the latter is displaced.

Figure 5:
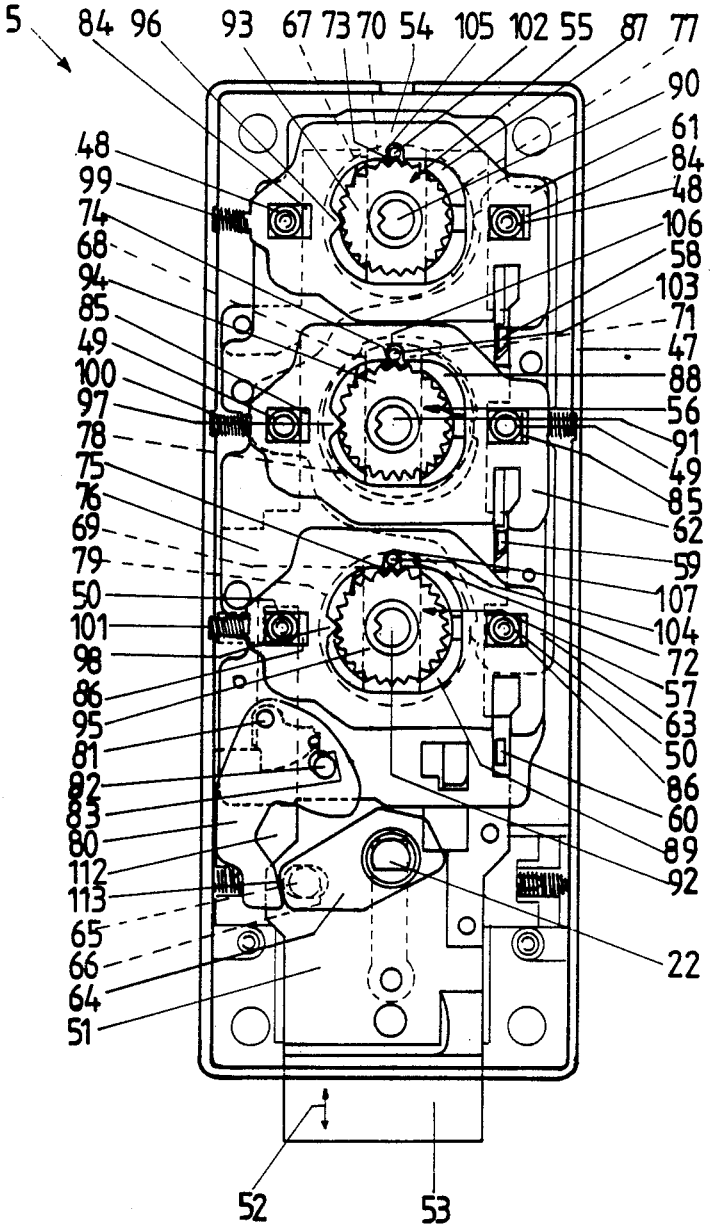
FIG. 5 is a top view of the permutation lock as per FIG. 4, but in the closed position.

The permutation lock 5 operates as follows: The intended starting position of bolt slide 51 is shown in FIG. 4, i.e. the bolt slide is in the open position. The three coding knobs 7 which are connected to and rotate with the corresponding toothed disks 93 to 95 are positioned at any setting which the user wishes to select; this setting will be called the combination code and it may for example consist of the following sequence of digits: 1, 2 and 3, i.e. at one of the coding knobs the digit 1, at another coding knob the digit 2 and at the last coding knob the digit 3 have been set. The respective setting of the coding knobs is fixed by engagement of the locking teeth 96 to 98 in the teeth of the toothed disks 93 to 95. The change-over slide 56 is located in its retracted position, i.e. it is displaced in the direction of the arrow 108. As a result, the locking slides 70 to 72 are displaced in such a way via the recesses 77 to 79 in the change-over slide 56 that the locking teeth 73 to 75 are out of engagement with the corresponding teeth in the toothed disks 93 to 95. The locking disks 55 to 57 arranged between the toothed disks 93 to 95 are aligned in such a way that the locking pins of the locking slide 51 engage in their radial slots (not illustrated). If shaft 22 is now rotated counterclockwise by means of the operating knob 6, arm 64 is pivoted and via pin 65, which engages in hole 66, moves the bolt slide 51 in the opposite direction of arrow 108. Once the knob has been turned to its fullest extent the bolt slide 51 is located in its locked position as shown in FIG. 5 where the head section of the bolt 53 projects out of lock case 47. In this position the safe door is locked. By swiveling arm 64 the latter leaves the open-ended recess 112 in control link 80 and comes to rest against contact surface 113 of control link 80 causing this control link to pivot around pin 81. This movement displaces the change-over slide 76 via control pin 82 and elongated hole 83 in the opposite direction of arrow 108. In the process the recesses 87 to 89 in the change-over slide 76 engage with and move the locking slides 70 to 72 so that their locking teeth 73 to 75 come into engagement with the corresponding teeth in the toothed disks 93 to 95. By moving the bolt slide 51 into its locked position (see FIG. 5) the locking bolts are caused to move out of the corresponding slots in locking disks 55 to 57. These locking disks can then be rotated by operating the coding knobs 7 because the locking slides 70 to 72 are positively connected via grooves 67 to 69 with the locking disks 55 to 57 and, because of the engagement of the locking teeth 73 to 75 in the teeth of the toothed disks 93 to 95, a positive connection exists between the locking slides 70 to 72 and the toothed disks 93 to 95. It is necessary to operate the coding knobs 7 so that, after the safe 1 has been locked it is no longer possible to read out the combination code of the permutation lock 5 which was stored when the bolt slide 51 was moved to the closed position. The combination code is stored by engagement of the locking teeth 73 to 75 in the teeth of the toothed disks 93 to 95. If, once the permutation lock 5 is locked, the toothed disks 93 to 95 are rotated by the control knobs 7, the locking disks 55 to 57 attain their position relative to the toothed disks 93 to 95 because of the positive connections which exist as described above. The bolt slide 51 cannot be returned to the open position by rotating the shaft 22 in a clockwise direction until the radial slots in the locking disks 55 to 57 are in alignment with the locking pin of bolt slide 51. This position, however, corresponds to the stored combination code, i.e. the locking disks 55 to 57, and thus the toothed disks 93 to 95, must assume the same position that they were in when the bolt slide 51 was moved to the locked position. However, this setting can be discovered by using the markings 102 to 104 on the locking slides 70 to 72 and by rotating the coding knobs 7 until the markings 102 to 104 are visible through the openings 108 described above in the lock case lid 178. But, in the safe which is the subject of the invention, this method of finding out the combination code can only be carried out if the user has forgotten his combination code so that he must call on the assistance of an authorized person; the latter removes the panel 8 on safe door 3 and also removes a further covering panel 179 bearing markings 37 and arranged beneath panel 8 and secured by a seal 183; then, by appropriately rotating the coding knobs 7, the markings 102, which may take the form of red dots, can be brought into alignment with the corresponding openings 180 in the lock case lid 178. This setting of the coding knobs corresponds once more to the previously set combination code 1, 2 and 3. When the bolt slide 51 is retracted to the open position, the positive connection between the locking slides 70 to 72 and toothed disks 93 to 95 is cancelled so that a new combination code can be set. This new combination code is again stored once the bolt slide 51 is closed. Moving the bolt slide 51 back from the open to the closed position also displaces the extension 111 (FIG. 12), which then interacts with the auxiliary lock 20 which is described in detail below.

The auxiliary lock 20, which is described in particular in FIGS. 6 to 10, takes the form of a coin-operated release mechanism 19 and possesses a boxlike lock case 114 having a front wall 115 and right angled side walls 116 to 119. The lock mechanism is covered by a rear wall 120 which is held in place by means of a screw 122 engaging in a square stud 121 in the lock case 114. A locking slide 123 is slidingly located in the lock case 114 in such a manner that it moves in the direction of the double arrow 124. The locking slide 123 is guided by a tail section 125 having a slot 126 which engages around the square stud 121.

A pawl 128 is located above the locking slide 123; this pawl is pivotably mounted on a stud 127 fitted in the corner of the lock case between side walls 116 and 119 of the lock case. A leaf spring 129 applies force in a clockwise direction to the pawl 128 causing the pawl 128 to rest with a locking tooth 130 engaged in a toothed recess 131 of the locking slide 123.

The upper side wall 116 of the lock case continues into a projecting section 132 which, on its inclined flank 133 facing side wall 119 of the lock case, forms a shaft 134 of a coin insertion plate 135. This plate is fitted with two calibrated coin insertion slots. The coin insertion plate 135 is positioned in such a way that one of the coin insertion slots is exposed. As a result, a coin can be inserted into the auxiliary lock 20. By removing the coin insertion plate 135 and rotating it through 180° it can be positioned so that the other coin slot can be used.

Figure 11:
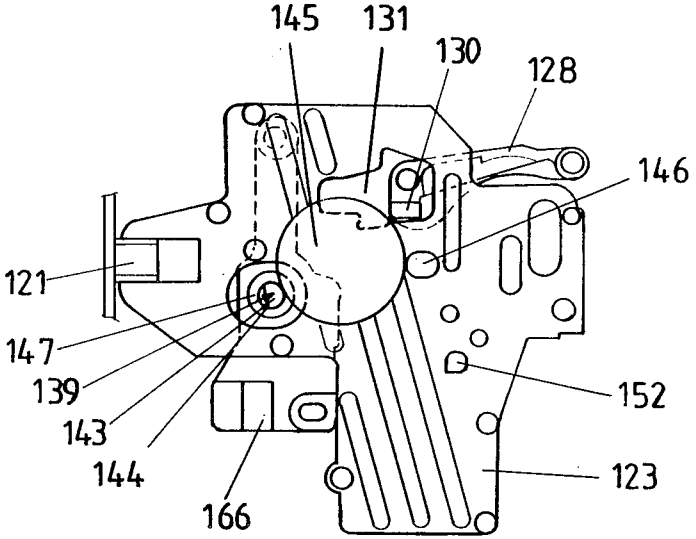
FIG. 11 is a front view of the locking slide of the auxiliary lock with inserted coins.

In the rear area of locking slide 123, a lever 136 extends between the rear wall 120 of the lock case and the locking slide 123. This lever is pivoted around a stud 137 mounted on the upper side of locking slide 123. In its central section the lever 136 is fitted with a borehole 138 to receive a rotating cam 139. The borehole 138 forms two diametrically opposed recesses 140 into which diametrically opposed projections 141 on the rotating cam 139 extend. The cam 139 possesses a slot 142 for a change-over tool (not illustrated). The end 143 of the cam 139 opposite slot 142 projects beyond the back of lever 136 and is provided with a flattened section 144 so that an eccentric is formed. The end 143 projects as far as the front wall 115 of the lock and provides the first point of contact for an inserted coin 145, see also FIG. 11. The coin 145 is shown in several positions in FIG. 7.

The contact point (end 143) is opposed on the bolt side by a contact point 146 and the distance between the two points is smaller than the diameter of the coin 145. In the area of the cam 139 a collar 147 projects from lever 136 and passes through an opening 148 in the locking slide 123 (see FIG. 11 in particular).

Figures 6, 7:
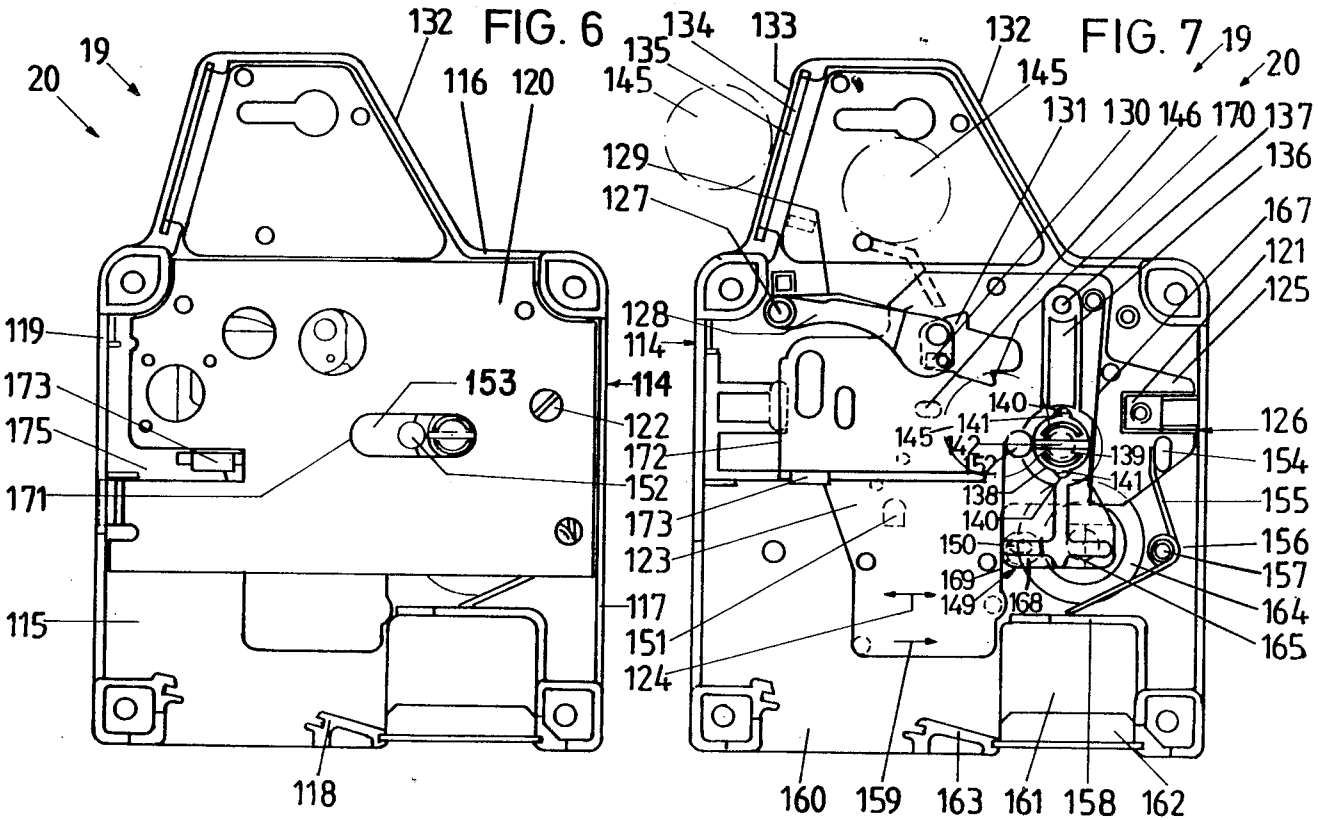
FIG. 6 is a rear view of an auxiliary lock in the form of a coin-operated release mechanism.
FIG. 7 is a rear view of the auxiliary lock as per FIG. 6 in the opened position; the insertion of a coin is denoted by the dot-dash outline.

At end 149 corresponding to the direction of fall of the coin, lever 136 is fitted with a second contact point 150 which is spaced at a certain distance from a second bolt contact point 151 when the lever 136 is in its resting position (see FIG. 7). The side of the lever 136 facing the back wall 120 of the lock is provided with a steering cam 152 which engages in an elongated opening 153 located in the rear wall 120 of the lock, in the direction of movement of the slide The locking slide 123 is fitted with a stop 154 for a spring 155 acting on the locking slide 123; one free end of this spring rests against stop 154, a spiral mid-section 156 of the spring fits around a pin 157 in the lock case 114, and the other free end rests against a wall 158 of the lock case 114. By this means the locking slide 123 is spring loaded in the direction of the arrow 159.

Two coin exit openings 160 and 161 are formed below the locking slide 123. The coin exit opening 161 is formed into a coin return compartment by a removable bottom wall 162. FIG. 7 shows that the coin return path is located above an angled separating wall 163 between the two coin exit openings 160 and 161.

Figure 10:
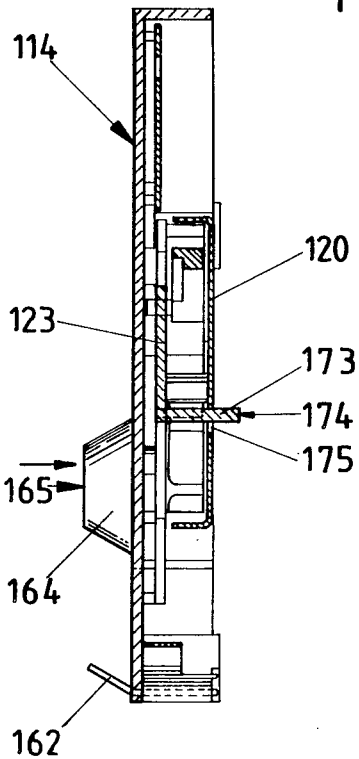
FIG. 10 is a lateral cross-sectional view through the auxiliary lock as per FIG. 6.

In order to permit coins to be returned, the front wall 115 of the lock carries a spring loaded coin return button 165 mounted at a thickening in the material of the wall 164 (see FIG. 10). The end of the button facing the lever 136 is conical in shape and it acts together with an inclined surface 166 on lever 136 (see FIG. 11). If the coin return button 165 is pushed in the direction of the arrow as shown in FIG. 10, the end of the button comes into contact with the inclined surface 166 of lever 136 causing the latter to pivot in such a way that the distance between the eccentric end 143 of cam 139 and the bolt contact point 146 is greater than the diameter of the coin 145. The coin 145 then falls through and is guided to the angled separating wall 163 from where it proceeds to coin exit opening 161. To ensure that the lever 136 always occupies its resting position and returns to this position again after pivoting, the lever is spring loaded in a clockwise direction by a leaf spring 167. Its resting position is determined by the fact that a collar 168 around contact point 150 comes into contact with the corresponding narrow edge 169 of the locking slide 123 (see in particular FIG. 7).

When the auxiliary lock 20 is adjusted for single coin operation the cam 139 is so located that the flat surface 144 of end 143 faces away from the first bolt contact point 146. When the necessary coin 145 is inserted, it runs through the various positions illustrated by dot-dash outlines in FIG. 7 and comes to a resting position defined by the contact point at end 143 and the bolt contact point 146. In FIG. 7 the locking slide 123 is shown in the open position. If the locking slide 123 is now to be activated it is moved in the opposite direction to the arrow 159 shown in FIG. 7. As the locking slide is being moved into the closed position, the edge of coin 145 makes contact with the locking tooth 130 of pawl 128. As a result, the pawl 128 is raised so that it moves out of the way of a locking shoulder 170 in recess 171. This is the position illustrated in FIG. 8. From this position the locking slide 123 is fully free to move to its closed position. In the final phase of the locking process the steering cam 152 of lever 136 contacts the edge 171 of opening 153 (see FIG. 6 in particular). As the locking slide 123 continues to move to the closed position the distance between the contact point at end 143 of cam 139 and the bolt contact point 146 becomes larger than the diameter of the coin 145 so that the latter falls down and through the coin exit opening 160.

If it is desired to convert the auxiliary lock 20 to multi-coin operation this can be done by rotating cam 139 through 180° using a change-over tool (not illustrated) which engages in slot 142. In this setting the flat surface 144 of end 143 is facing towards the bolt contact surface 146. The distance between these two points is thus greater than the diameter of the coin 145. This distance is also greater than the distance between the first contact point 150 of lever 136 and the second bolt contact point 151. The first coin 145 inserted consequently comes to rest against the second bolt contact point 151 and the second contact point 150. The next coin 145 that is inserted comes to rest against the upper edge of the first coin 145. Therefore, although its diameter is smaller than the distance between the points at the end 143 of cam 139 and contact point 146, it cannot fall through. As the locking slide is being moved to the closed position the pawl 128 is raised in the manner described above by the last coin 145 which was inserted. When locking slide 123 is in the fully closed position lever 136 is also moved out of its resting position so that the coins 145 are released and can drop down. The collection (coin exit opening 160) or the return (coin exit opening 161) of the coins 145 then takes place in the same way as described above.

Figure 9:
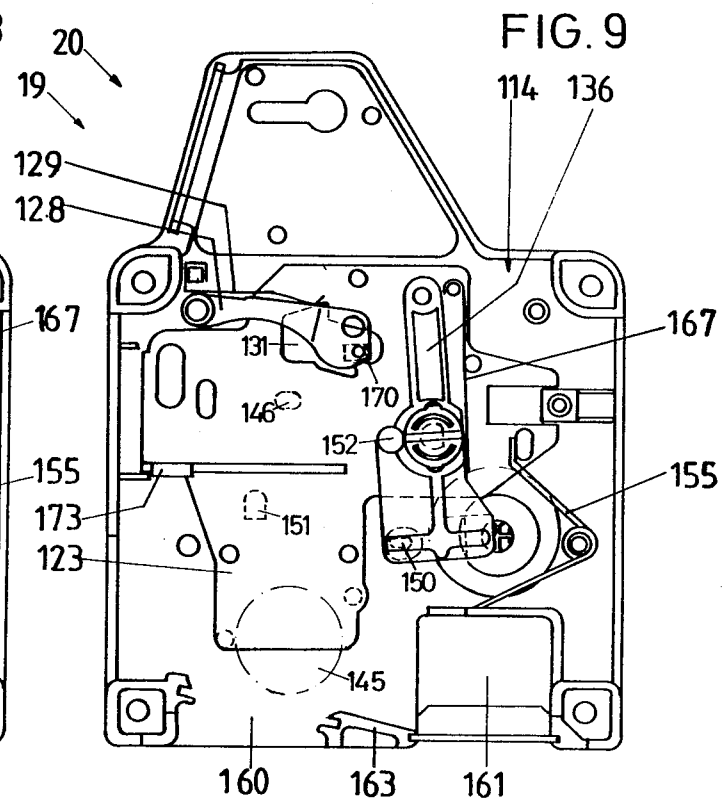
FIG. 9 is a rear view of the lock as per FIG. 7, but in the locked position.
Figure 8:
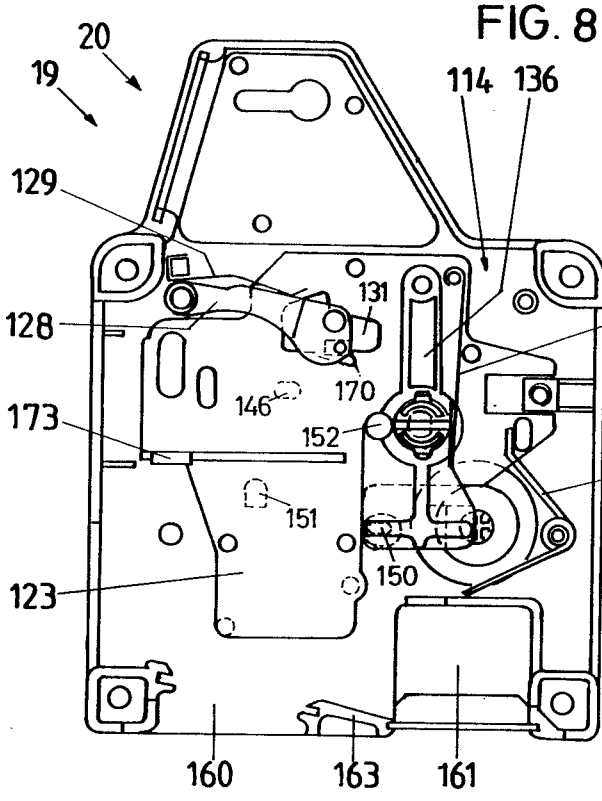
FIG. 8 is a rear view of the lock as per FIG. 7, but with the locking slide in the intermediate position.

It should be pointed out that FIG. 9 shows the locking slide in the locked position with lever 136 deflected to release coin 145.

Near edge 172 of the locking slide 123 there is a projection 173 running perpendicular to the plane of the front wall 115 of the lock. The length of the projection 173 is particularly apparent in FIG. 10. The end 174 of this projection 173 projects through an open sided recess 175 in the back wall 120 of the lock.

It is clear from FIG. 12 how the permutation lock 5 is arranged relative to the auxiliary lock 20 of the safe door 3. Both locks 5 and 20 are arranged back-to-back. The inner wall 12 of safe door 3 runs between the two locks 5 and 20. The permutation lock 5 is attached to the inner side of the inner wall 12 while the auxiliary lock 20 is located on the outer side 18 of inner wall 12. As shown in FIGS. 2 and 12 the inner wall 12 is penetrated by an opening 176 and the auxiliary lock 20 is attached in such a way on inner wall 12 that the free end 174 of projection 173 of the locking slide 123 passes through this opening 176. The permutation lock 5 is positioned in such a way that the extension 111 of bolt slide 51 comes to rest above opening 176. The extension 111 of the bolt slide 51 is in contact with the projection 173 of locking slide 123 thus forming a coupled connection 177.

The operation of the safe according to the invention is thus as follows:

If a person wishes to use the safe, for example to store valuables safely, he must first open the safe door, which has been left unlocked by the previous user. Once the valuables have been placed in the safe he inserts a coin 145 into the coin insertion plate 135 on auxiliary lock 20. If the auxiliary lock is set up for two-coin operation, then it is necessary to insert the requisite two coins 145. The change-over from single-coin operation to two-coin operation can be effected as already described. Once the coins have been inserted, the user closes the safe door 3 and then by operating the coding knobs 7 selects his personal secret code (e.g. a number combination 1, 2, 3 or also a combination of letters such as A, B, C, if the coding knobs are marked with letters). Then he locks the safe door 3. This is done by rotating the operating knob 6 of permutation lock 5. By actuating the operating knob 6 the bolt slide 51 of the permutation lock 5 is moved to the locked position and the head section 53 of the bolt engages in the striking plate system installed in the door frame of the safe. As already described, the displacement of the bolt slide 51 on the one hand causes the combination to be stored and on the other hand drags with it the projection 173 of the locking slide 123 in the auxiliary lock 20. Since the user has inserted a coin 145 into the auxiliary lock 20, the bolt slide 51 can simultaneously move the locking slide 123 to its fullest extent because, as already described, the edge of the coin lifts the locking pawl 128 so that no resistance is offered to the displacement of the locking slide 123. If however the user does not insert any coin into the auxiliary lock 20, the locking slide 123 cannot be fully displaced because the locking tooth 130 of the pawl 128 comes against the locking shoulder 170 of recess 131; consequently, despite the coupled connection 177 with the bolt slide 51, the locking slide 123 cannot be moved to its closed position. Thus, the permutation lock cannot be closed. The locking procedure can only be accomplished if a coin is inserted. As already described, in the lock end position the lever 136 in the auxiliary lock 20 is displaced so that the coin 145 falls out of the coin exit opening 160 and reaches the coin collecting chamber 15 via the vertical coin chute 24 and the inclined coin chute 23 in safe door 3. The user now notes his combination (if he has not already done so) and scrambles the coding knobs 7.

If the user later wishes to open the safe door 3 he first selects his secret combination by rotating the coding knobs 7 and this releases the permutation lock, as already described. By operating the operating knob 6 it is then possible to retract the bolt slide 51 of the permutation lock. The door of the safe can be opened. Because of the coupled connection 177 unlocking the permutation lock the auxiliary lock 20 also returns to its original position. The user, or another user, can then make use of the safe again in the manner described.

From the foregoing it is clear that the object of the invention thus makes it necessary to insert a coin each time in order to close the permutation lock, and each time the secret combination is stored. If the user forgets his combination, an authorized person, e.g. the hotel detective, should be called who has a key to unlock the fastening element 38 of panel 8. When he opens the fastening element 38 he can remove panel 8. After also removing the additional panel 179, the selected combination can be discovered, in the manner already described, by setting the markings in the corresponding openings 180 in the lid 178 of the case of the permutation lock. The safe door 3 can then be opened. Once this is done, the additional panel 179 is fitted with a new seal and the panel 8 is locked by operating the fastening element 38.

The coin collecting chamber 15 can be emptied without the user of the safe having to be present because it is not necessary to open the safe door 3 to get at the money. Instead, an authorized person can use a key to unlock the fastening element 29, then remove lid 11, thus giving access to the coin collecting chamber 15. The authorized person thus does not have access to the interior of the safe because the coin collecting chamber 15 is screened off from the safe by the inner wall 12.

Figure 13:
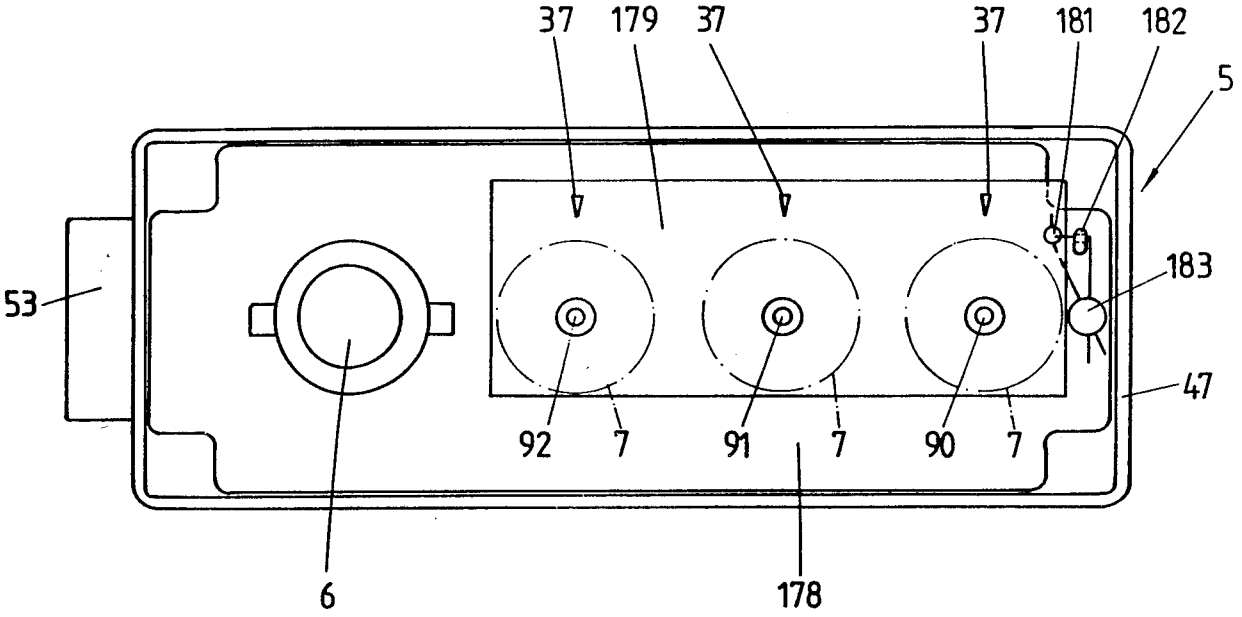
FIG. 13 is a top view of the removed permutation lock with covering panel.

FIG. 13 shows a top view of the permutation lock 5 after it has been removed from the safe door 3. The permutation lock 5 is in the closed position so that the head section 53 of the bolt projects from the lock case 47. The operating knob 6 is in a position corresponding to the closed position of the bolt. In addition, FIG. 13 shows that the inside of the lock case 47 is covered by the lock case lid 178. The latter possesses openings through which pass the shaft 22 of the operating knob 6 and the shafts of the coding knobs 7. A covering panel 179 is arranged on the lock case lid 178 and this panel cannot be removed until at least one seal 83 has been broken; removal of the panel exposes the openings 118 in the lock case lid 178 (see FIG. 14); these openings are arranged in each case to the right of the corresponding shafts 90 to 92 of the coding knobs 7. The sealing of the panel can be effected for example by providing a hole 181 on the covering panel 79 and an eye 182 on the lock case lid 178, and through this hole and eye a safety wire is then passed whose ends are joined together by a seal 183. Markings 37 allocated to the coding knobs 7 can be arranged on the covering panel 79.

Figure 14:
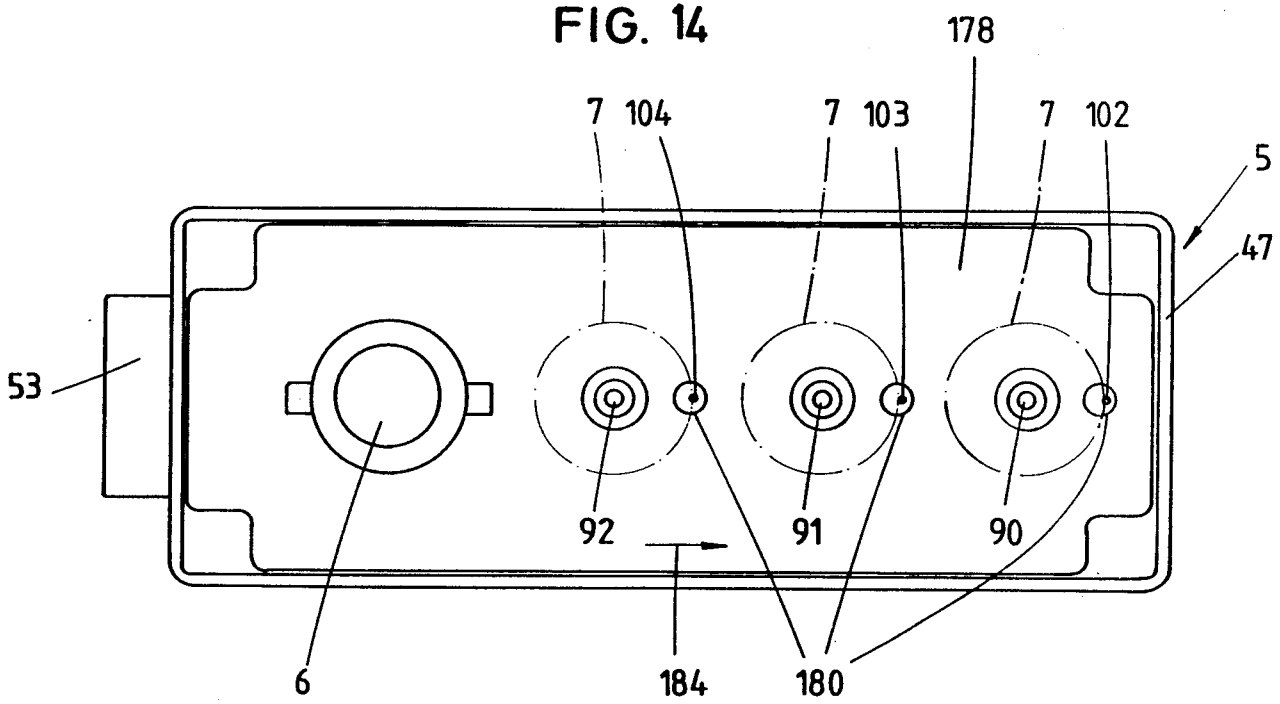
FIG. 14 is a top view of the removed permutation lock without the covering panel.

In accordance with FIG. 14 the openings 180 in the lock case lid 178 are exposed when the covering panel 179 is moved. The markings 102 to 104 can be seen in the holes when the permutation lock 5 is locked. These markings 102 to 104 can for example take the form of red dots. If the permutation lock 5 is in the open position the markings 102 to 104 move out of the openings 180 in the direction of the arrow 184 so that they are no longer visible. Similarly, the markings 102 to 104 are not visible when the permutation lock is locked and the combination code has not been set at the coding knobs 7 because the markings 102 to 104 are then moved out of the openings 180 by the pivoting of the locking slides 70 to 72.

FIGS. 15–22 show a further embodiment of the invention which differs from the previously described embodiment in that a supplementary lock 261 is used. In all other respects the description of the previous embodiment applies in this case as well.

Figure 16:
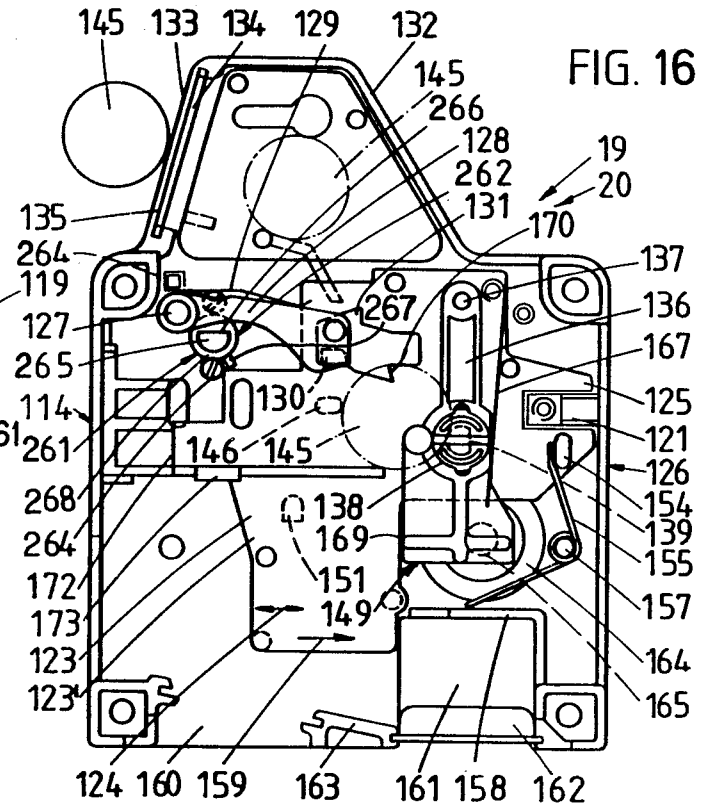
FIG. 16 is a rear view of the coin-operated release mechanism in the opened position in which the dot-dash outline of an inserted coin can be seen; the auxiliary lock which can be used to release the locking slides is shown in the disengaged position.
Figure 15:
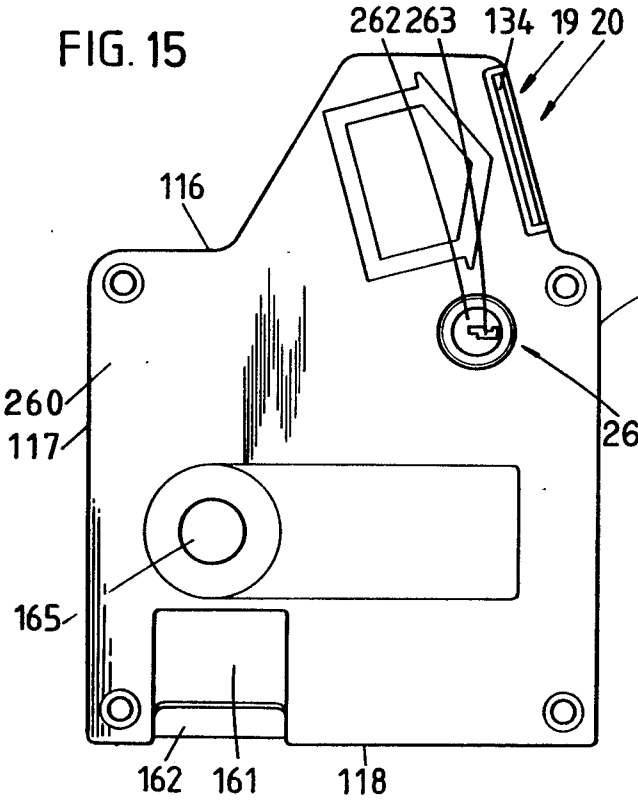
FIG. 15 is a front view of a lock in the form of a coin-operated release mechanism, and exhibiting an auxiliary lock, which acts in conjunction with the permutation lock.
Figure 17:
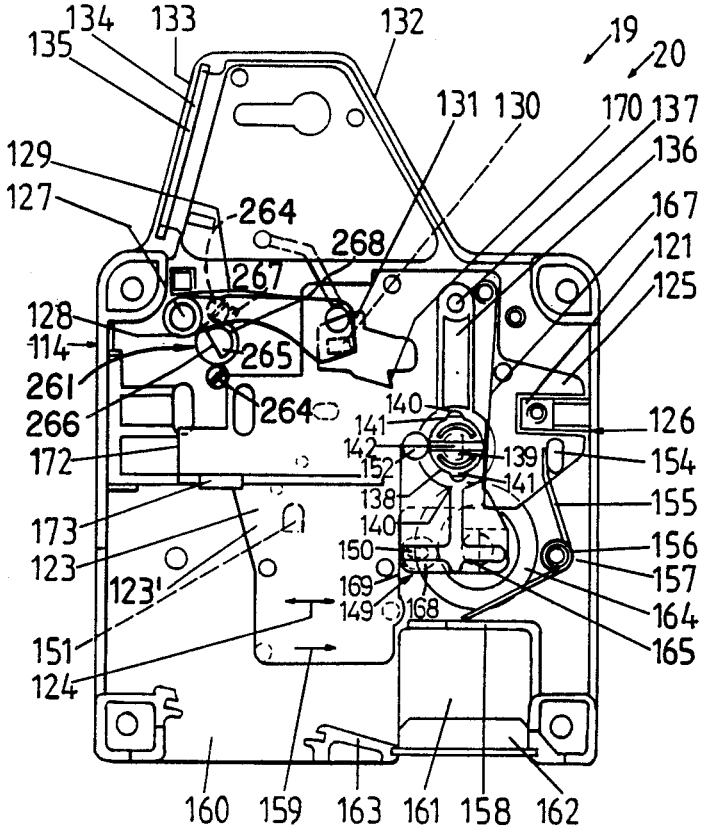
FIG. 17 is a rear view of the coin-operated release mechanism as per FIG. 16, but without an inserted coin, and with the auxiliary lock in the closed position.
Figure 19:
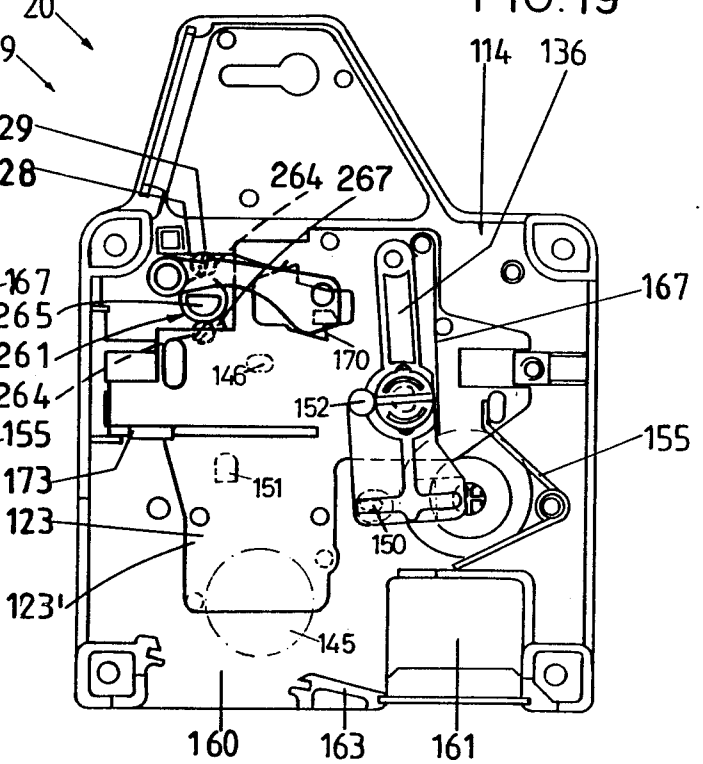
FIG. 19 is a rear view of the coin-operated release mechanism as per FIG. 18 with the locking slide displaced to the end position.
Figure 18:
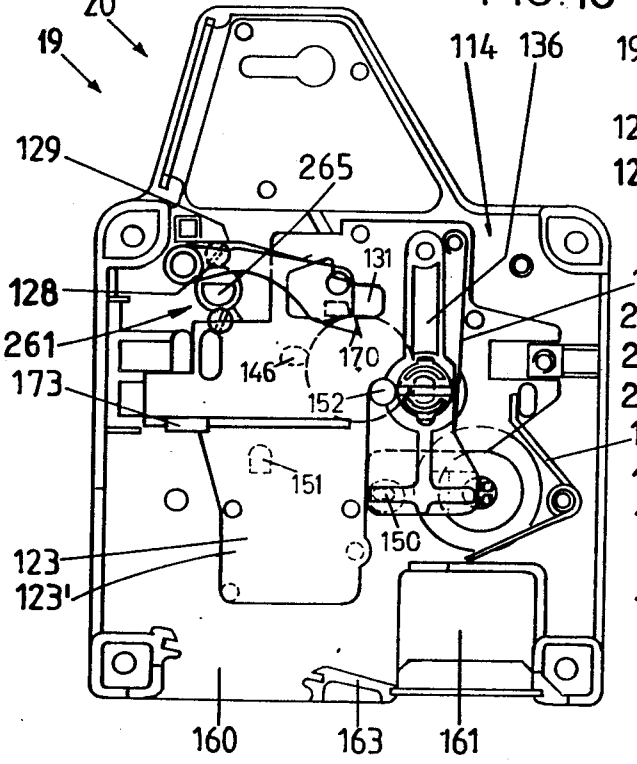
FIG. 18 is a rear view of the coin-operated release mechanism as per FIG. 16 with the locking slide displaced.
Figure 21:
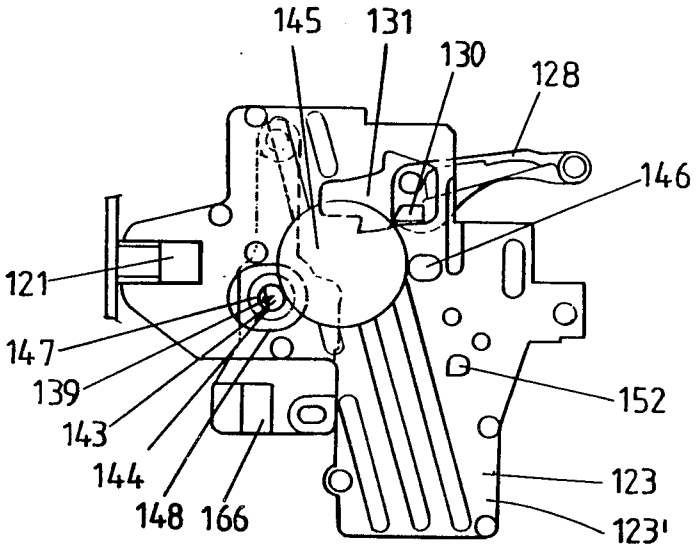
FIG. 21 is a front view of the locking slide of the coin-operated release mechanism, equipped with an auxiliary lock, with an inserted coin.
Figure 20:
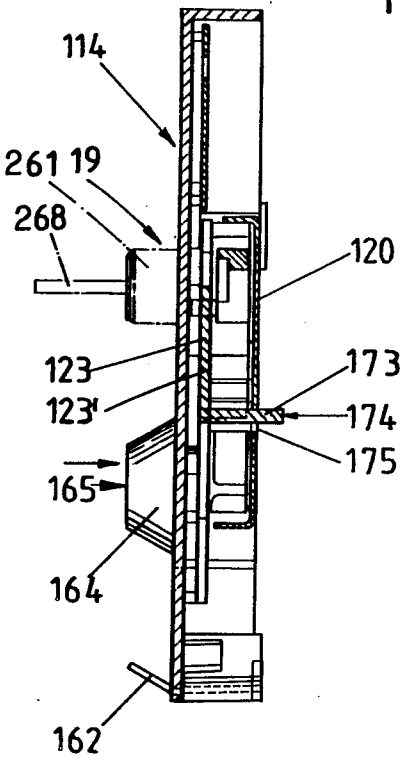
FIG. 20 is a lateral cross-section through the coin-operated release mechanism equipped with an auxiliary lock.
Figure 22:
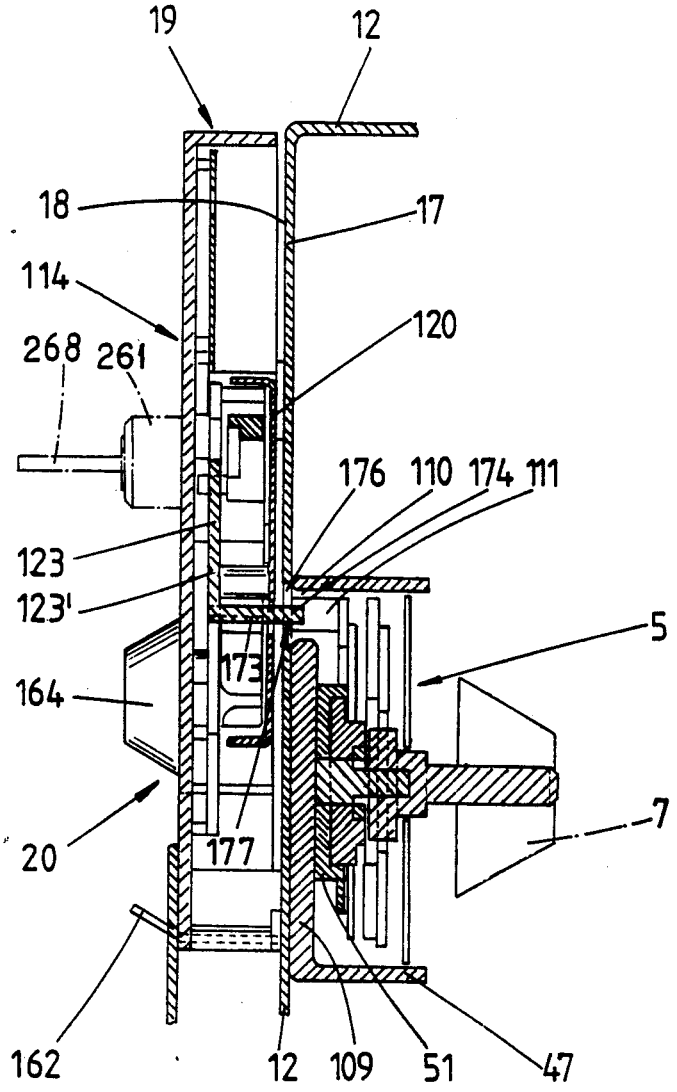
FIG. 22 is a cross-sectional view through an area of the safe door showing the back-to-back arrangement of the permutation lock and the coin-operated release mechanism with auxiliary lock.

It is in particular clear from FIGS. 15 to 20 that the coin-operated release mechanism 19 has a supplementary lock 261 on its front side 260. This supplementary lock 261 is fitted with a locking cylinder 262 possessing a key channel 263. FIG. 16 shows a rear view of the supplementary lock 261. It is apparent from this FIG. that the lock is attached by means of two screws 264 which pass through the front side 260 of the coin-operated release mechanism 19. The locking cylinder 262 possesses a web (key bit) 265 which is cylindrical in shape with a flattened section 266. To this web (key bit) 265 is attached a radial stop pin 267 which can interact with the heads of the screws 264. In this way, the angle of rotation of the web (key bit) 265 and thus of the key for the supplementary lock 261 is restricted, and the ends of the range of angular rotation are defined by the contact made between the stop pin 267 against the heads of the screws 264. The supplementary lock 261 is thus arranged in such a way on the coin-operated release mechanism 19 that its web (key bit) 265 is located below the pawl 128. This permits the following method of operation:

FIG. 16 shows the supplementary lock 261 in the open position in which the key 268 (see FIG. 20) of the supplementary lock 261 can be freely inserted into or removed from this lock. The flattened section 266 of the web (key bit) 265 is located at a distance from the pawl 128 of the lock 20 which takes the form of a coin-operated release mechanism 19. In this position the stop pin 47 is in contact with the head of the lower screw 264. If the key 268 is now introduced into the key channel 263 and rotated, the web (key bit) 265 is also rotated and with it the stop pin 267 which comes to rest against the head of the upper screw 264, and at the same time the position of the flattened section 266 of web (key bit) 265 is changed. In this position the cylindrical surface 268 of web (key bit) 265 acts against the underside of pawl 128 which is then lifted and caused to rotate about stud 127. Locking tooth 130 of pawl 128 then occupies a position in which it can no longer engage against shoulder 170 of recess 131 in locking slide 123 when the latter is displaced in the opposite direction of arrow 159. When the supplementary lock 261 is in this closed position the locking slide 123, which forms a locking element 123', of the coin-operated release mechanism 19 is released.

The supplementary lock 261 is equipped with means which prevent the key 68 from being withdrawn when the lock is activated. Withdrawal of the key 268 is possible only when the lock is in the open position.

As already described, in addition to activating the coin-operated release mechanism 19 by inserting a coin 145, the locking slide 123 can also be displaced in the opposite direction to the arrow 159 when the supplementary lock 261 is activated so that its web (key bit) 265 lifts up the pawl 128. Consequently, the locking slide can be displaced either by inserting a coin in the coin-operated mechanism or by operating supplementary lock 261. The locking slide can also be moved if both such actions are taken, although this is unlikely to happen in practice.

It is clear from the foregoing that the safe which is the object of the invention requires the insertion of a coin, or the possession of a key to operate the supplementary lock, each time the permutation lock is activated. When the permutation lock is activated the combination code is stored.

I claim:

1. A safe comprising
a safe door;
a permutation lock including a bolt slide for locking said door, the permutation lock having an externally operable reset device for resetting a combination of the lock;
a coin-operated release mechanism adapted for releasing the bolt slide of said lock for locking said door of the safe and wherein
said coin-operated release mechanism comprises an auxiliary lock;
said auxiliary lock includes an auxiliary locking slide operable by said release mechanism for locking said safe;
said release mechanism is operative to release a locking function of said release mechanism upon insertion of a coin;
upon insertion of the coin, said auxiliary lock operates to release said auxiliary locking slide to move in coupled connection with said bolt slide of the permutation lock;
said coin-operated release mechanism includes a supplementary lock for releasing a locking element in said release mechanism without the insertion of a coin, and wherein
said supplemental lock includes a web and a locking pawl operative with said locking slide, said pawl being movable to an unlocking position by operation of a coin or said web.

2. A safe according to claim 1, wherein
said permutation lock comprises means for storing a selected combination, said storing means being activated upon a displacement of said bolt slide.

3. A safe according to claim 1, further comprising
a removable lockable panel accessible from outside the safe; and
the combination is exposed by removal of said lockable panel.

4. A safe according to claim 3, further comprising
at least one fastening element for locking said lockable panel, said at least one fastening element being operable from outside the safe.

5. A safe according to claim 4, further comprising
a panel lock; and
said fastening element has the form of a threaded bolt and is secured by means of said panel lock against being turned.

6. A safe according to claim 5, wherein
said safe door has a threaded borehole; and
said threaded bolt is disposed on said panel and cooperates with said threaded borehole.

7. A safe according to claim 1, wherein said permutation lock further comprises:

a plurality of coding knobs;
a bolt and said bolt slide;
locking pins and rotatable locking disks;
a change-over slide and a plurality of locking slides;
a plurality of toothed disks; and
a housing wall having openings therein; and wherein
said coding knobs serve for setting
the combination, said combination being secret and stored in said lock;
said bolt is movable between two end positions;
said bolt slide bears said locking pins for interaction with said locking disks, which discs are controlled by said coding knobs;
said change-over slide decouples said coding knobs from said locking disks;
each of said locking disks has on the side facing away from said bolt slide a diametrical groove carrying a respective one of said locking slides which is coupled with said change-over slide and engages in a respective one of said toothed disks, said toothed disks being linked with respective coding knobs; and
said locking slides bear markings which are visible through said openings in said housing wall of said permutation lock only when the locking slides and the respective toothed disks are engaged at the setting of the stored secret combination.

8. A safe according to claim 7, further comprising
a plurality of spring-loaded tumblers; and wherein
said toothed disks are arranged together with respective ones of said tumblers which cover at least parts of said locking slides;
said tumblers are released only when said bolt slide is at one of its end positions; and
said tumblers have recesses for revealing the markings.

9. A safe according to claim 7, further comprising
a door frame fitted with a striking plate;
a bolt engaging said striking plate and being formed with a head section; and
an operating knob mechanically coupled to said bolt slide; and wherein
the head section of said bolt engages said striking plate when the lock is closed; and
said head section is formed by an extension of said bolt slide of the permutation lock, said bolt slide being movable by said operating knob.

10. A safe according to claim 1, wherein
the permutation lock cooperates with said auxiliary locking slide such that said permutation lock is operable to lock the safe door if and only if said auxiliary locking slide is released.

11. A safe according to claim 1, wherein
said coin-operated release mechanism comprises a coin collecting chamber and a vertical coin chute opening into said coin collecting chamber, there being a lockable lid extending over part of the outer side of said safe door and in front of said collecting chamber.

12. A safe according to claim 11, further comprising
at least one fastening element which is lockable from outside the safe for securing said lockable lid.

13. A safe according to claim 12, further comprising
a bolt lock; and wherein
said fastening element has the form of a threaded bolt which is secured by said bolt lock against being turned.

14. A safe according to claim 13, wherein
a threaded borehole is located in the safe door; and
said threaded bolt is disposed on said lid and cooperates with said threaded borehole in the safe door.

15. A safe according to claim 1, wherein
said permutation lock and said coin-operated release mechanism are arranged back-to-back.

16. A safe according to claim 1, wherein
the safe door is of double wall construction having an inner wall and an outer wall, there being an opening in said inner wall;
said coin-operated release mechanism is located on the outer side of said inner wall and said permutation lock is located on the inner side of the inner wall; and
said coupled connection passes through the opening in the inner wall.

17. A safe according to claim 16, wherein
said coin-operated release mechanism comprises a coin collecting chamber and a vertical coin chute opening into said coin collecting chamber, there being a lockable lid extending over part of the outer side of the safe door and in front of said collecting chamber; and wherein the inner wall and outer wall of the safe door forms said coin collecting chamber.

18. A safe according to claim 16, wherein
said coin-operated release mechanism comprises a coin collecting chamber and a vertical coin chute opening into said coin collecting chamber, there being a lockable lid extending over part of the outer side of the safe door and in front of said collecting chamber; and wherein
a coin slide links the vertical coin chute of the auxiliary lock with the coin collecting chamber and passes through the inner wall.

19. A safe according to claim 1, wherein
said permutation lock operates in conjunction with said locking element in the coin-operated release mechanism, said mechanism is releasable by inserting a coin.

20. A safe according to claim 19, wherein
said supplementary lock comprises a key-operated locking device.

21. A safe according to claim 20, wherein
said locking device is a locking cylinder.

22. A safe according to claim 19, wherein
said locking element is formed of said locking slide which is released upon insertion of a coin or by operation of the supplementary lock, said locking slide being operably coupled via said coupled connection with the bolt slide of said permutation lock.

23. A safe according to claim 22, wherein said
coupled connection comprises an extension of said bolt slide and a projection on said locking slide, said extension being in contact with the projection.

24. A safe comprising
a safe door;
a permutation lock including a bolt slide for locking said door, the permutation lock having an externally operable reset device for resetting a combination of the lock;
a coin-operated release mechanism having a coin collection chamber and being adapted for releasing the bolt slide of said lock for locking said door of the safe;
a covering panel and at least one seal;
a removable lockable panel accessible from outside the safe; and wherein the combination is exposed by removal of said lockable panel; and said covering panel is located beneath said lockable panel, said covering panel being secured to said safe by said at least one seal, said covering panel providing access to said coin collection chamber.

25. A safe comprising a safe door;

a permutation lock including a bolt slide for locking said door, the permutation lock having an externally operable reset device for resetting a combination of the lock;

a coin-operated release mechanism adapted for releasing the bolt slide of said lock for locking said door of the safe; and wherein said coin-operated release mechanism comprises an auxiliary lock;

said auxiliary lock includes an auxiliary locking slide operable by said release mechanism for locking said safe;

said release mechanism is operative to release a locking function of said release mechanism upon insertion of a coin;

upon insertion of the coin, said auxiliary lock operates to release said auxiliary locking slide to move in coupled connection with said bolt slide of the permutation lock;

the safe door is of double wall construction having an inner wall and an outer wall, there being an opening in said inner wall;

said coin operated release mechanism is located on the outer side of said inner wall and said permutation lock is located on the inner side of the inner wall;

said coupled connection passes through the opening in the inner wall;

said permutation lock comprises means for storing a selected combination, said storing means being activated upon a displacement of said bolt slide;

said safe includes a removable lockable panel accessible from outside the safe;

the selected combination is exposed by removal of said locking panel;

said coin-operated release mechanism comprises a coin collecting chamber and a vertical coin chute opening into said coin collecting chamber, there being a lockable lid extending over part of the outer side of the safe door and in front of said collecting chamber; and wherein said panel and said lid are mounted flush with said outer wall.

26. A safe comprising a safe door;

a permutation lock including a bolt slide for locking said door, the permutation lock having an externally operable reset device for resetting a combination of the lock; and a coin-operated release mechanism adapted for releasing the bolt slide of said lock for locking said door of the safe; and wherein said coin-operated release mechanism comprises an auxiliary lock;

said auxiliary lock includes an auxiliary locking slide operable by said release mechanism for locking said safe;

said release mechanism is operative to release a locking function of said release mechanism upon insertion of a coin;

upon insertion of the coin, said auxiliary lock operates to release said auxiliary locking slide to move in coupled connection with said bolt slide of the permutation lock;

said safe further comprises a locking element in said coin-operated release mechanism;

said permutation lock operates in conjunction with said locking element in the coin-operated release mechanism, said mechanism is releasable only by inserting a coin;

said coin-operated release mechanism includes a supplementary lock for releasing the locking element without the insertion of a coin; and said supplementary lock comprises means for preventing a key from being withdrawn when the lock releases the locking element.

27. A safe comprising a safe door;

a permutation lock including a bolt slide for locking said door, the permutation lock having an externally operable reset device for resetting a combination of the lock;

a coin-operated release mechanism adapted for releasing the bolt slide of said lock for locking said door of the safe; and wherein said coin-operated release mechanism comprises an auxiliary lock;

said auxiliary lock includes an auxiliary locking slide operable by said release mechanism for locking said safe;

said release mechanism is operative to release a locking function of said release mechanism upon insertion of a coin;

upon insertion of the coin, said auxiliary lock operates to release said auxiliary locking slide to move in coupled connection with said bolt slide of the permutation lock;

said safe further comprises a locking element in said coin-operated release mechanism;

said permutation lock operates in conjunction with said locking element in the coin-operated release mechanism, said mechanism is releasable only by inserting a coin;

said coin-operated release mechanism includes a supplementary lock for releasing the locking element without the insertion of a coin;

said locking element is formed of a further locking slide which is released upon insertion of a coin or by operation of the supplementary lock, said locking slide being operably coupled via said coupled connection with the bolt slide of said permutation lock;

said supplementary lock is formed with a web; and said coin-operated release mechanism comprises a pawl for engaging said locking slide, said pawl being pivoted to an unlocked position by contact with the edge of an inserted coin or by contact with the web of said supplementary lock.

28. In a safe having a safe door which closes by means of a combination lock, a release device being associated with the combination lock which has a key-secret resetting device which is actuatable from the outside, the improvement comprising a bolt slide of the combination lock, said release device comprises an auxiliary lock having a closure function adapted for release by injection of a coin or actuation of an additional supplementary lock and has a locking pawl for a locking slide, said pawl is swingably mounted and is swingable in unlocking position by application against a coin edge of an inserted coin or application of a closure web of the supplementary lock, and said slide is in coupling engagement with said bolt slide of the combination lock.

* * * * *